US012721492B2

(12) United States Patent
Jia

(10) Patent No.: US 12,721,492 B2
(45) Date of Patent: Sep. 1, 2026

(54) SPIN MOP HAVING VISIBLE SPIN-DRYING/CLEANING STATE

(71) Applicant: Xinghang Jia, Zhejiang (CN)

(72) Inventor: Xinghang Jia, Zhejiang (CN)

(73) Assignee: Xinghang Jia, Zhejiang (CN)

( * ) Notice: Subject to any disclaimer, the term of this patent is extended or adjusted under 35 U.S.C. 154(b) by 346 days.

(21) Appl. No.: 18/569,698

(22) PCT Filed: Dec. 30, 2021

(86) PCT No.: PCT/CN2021/143233

§ 371 (c)(1),
(2) Date: Dec. 13, 2023

(87) PCT Pub. No.: WO2022/262255

PCT Pub. Date: Dec. 22, 2022

(65) Prior Publication Data

US 2024/0268624 A1 Aug. 15, 2024

(30) Foreign Application Priority Data

Jun. 18, 2021 (CN) ..... 202121362048.9

(51) Int. Cl.
*A47L 13/42* (2006.01)
*A47L 13/256* (2006.01)
*A47L 13/58* (2006.01)

(52) U.S. Cl.
CPC ..... *A47L 13/42* (2013.01); *A47L 13/256* (2013.01); *A47L 13/58* (2013.01)

(58) Field of Classification Search
CPC ..... A47L 13/58; A47L 13/42; A47L 13/256
See application file for complete search history.

(56) References Cited

U.S. PATENT DOCUMENTS

2018/0028040 A1 2/2018 Delangue

FOREIGN PATENT DOCUMENTS

| | | | |
|---|---|---|---|
| CN | 203597904 | U | 5/2014 |
| CN | 209136481 | U | 7/2019 |
| CN | 112535443 | A | 3/2021 |
| CN | 112890710 | A | 6/2021 |
| CN | 215078143 | U | 12/2021 |

OTHER PUBLICATIONS

International Search Report and Written Opinion dated Mar. 29, 2022 for PCT Application No. PCT/CN2021/143233, 10 pages.

*Primary Examiner* — Shay Karls
(74) *Attorney, Agent, or Firm* — Pierce Atwood LLP; Christopher A. Baxter

(57) ABSTRACT

The present invention provides a spin mop with visible spin-drying/cleaning state, including a mop bucket and a spin mop. The mop bucket is provided with a support seat, the spin mop includes a mop rod and a mop head for installing a mop cloth. The mop head is provided with a color difference switching mechanism, the color difference switching mechanism includes a movable color block movably installed on the mop head and a visible window provided corresponding to the movable color block, the movable color block is slidably/swingingly connected to the mop head. When the mop head spins at a high speed to perform spin-drying, the movable color block slides/swings towards the visual window or the movable color block slides/swings away from the visual window, such that the movable color block is placed under or gets away from under the visual window.

10 Claims, 7 Drawing Sheets

SPIN MOP HAVING VISIBLE SPIN-DRYING/CLEANING STATE

CROSS-REFERENCE TO RELATED APPLICATIONS

This application is a National Stage 371 application claiming the benefit of International Application No. PCT/CN2021/143233, filed Dec. 30, 2021, which claims priority from Chinese Application No. 202121362048.9, filed Jun. 18, 2021, the entire contents of which are incorporated herein by reference.

TECHNICAL FIELD

The present invention relates to the technical field of cleaning tools, and in particular, to a spin mop with visible spin-drying/cleaning state.

BACKGROUND

Mop and bucket set is an important tool for household cleaning. There are various types and functions of existing mop buckets. Among them, spin mop buckets and mops are one of the daily products convenient for mopping the floor in recent years. They are generally divided into pedal type, hand pressure type, and electric type, which drive a cleaning mechanism inside the mop bucket to spin through pedal, hand pressure or electric methods, and most of them are of pedal type and hand pressure type. During use, the mop head is immersed into the mop bucket and placed on the cleaning mechanism, and the mop is wetted and cleaned by spinning.

Currently, mops in the market which are cleaned and spin-dried in a bucket can realize the spin-drying or cleaning state by switching between a high position and a low position of the mechanism on the mop head, or a high position and a low position can be set in the bucket to realize the spin-drying or cleaning state by switching between the high position and the low position. During use, it is difficult for users to observe the spinning speed of the mop head, making it difficult to distinguish whether the mop head is currently in a cleaning or spin-drying state, resulting in the use of the mop before it is thoroughly cleaned or has not been thoroughly dried after spin-drying, which is very inconvenient to use. Therefore, it is necessary to design a spin mop with visible spin-drying/cleaning state, such that users can distinguish whether the mop is in a cleaning or spin-drying state.

SUMMARY

(I) Technical Problem to Be Solved

The technical problem to be solved by the present invention is to provide a spin mop with visible spin-drying/cleaning state, which is simple in structure and low in production cost is low; the spin mop is provided with a color difference switching mechanism, making it easy for users to distinguish the cleaning or spin-drying state of a mop head.

(II) Technical Solution

In order to solve the above technical problem, the present invention provides a spin mop with visible spin-drying/cleaning state, including a mop bucket and a spin mop body. The mop bucket is provided with a support seat for supporting the spin mop body to spin, and the spin mop body includes a mop rod and a mop head for installing a mop cloth. The mop head is provided with a color difference switching mechanism, the color difference switching mechanism includes a movable color block movably installed on the mop head and a visible window provided corresponding to the movable color block, and the movable color block is slidably/swingingly connected to the mop head. When the mop head spins slowly to perform cleaning, the movable color block is stationary or moves slightly, and the color inside the visible window is unchanged. When the mop head spins at high speed to perform spin-drying, the movable color block slides/swings towards the visible window or the movable color block slides/swings away from the visible window, such that the movable color block is placed under or gets away from under the visible window, the color inside the visible window changes, and the users can distinguish the spinning speed of the mop head by the color of the visible window during use, thereby distinguishing whether the mop head is in a cleaning or spin-drying state according to the color of the visible window, which is convenient to use.

In the spin mop with visible spin-drying/cleaning state of the present invention, the visible window is fixedly provided with a transparent cover, which facilitates users to observe changes in the position of color blocks while playing a dust-proof role. The spin mop is simple in structure and low in production cost. The spin mop is provided with the color difference switching mechanism. The visible window can switch different colors according to the different spinning speeds of the mop head, making it easy for users to distinguish the cleaning or spin-drying state of the mop head, and making it convenient for users to spin-dry the mop, and thus the mop is more convenient to use. The mop head is provided with a sliding groove for installing a movable color block, and the movable color block is slidably installed inside the sliding groove and slides smoothly. The movable color block is provided with a damping mechanism. When the mop head spins slowly, the damping mechanism stops the color block from moving, i.e. prevents the color block from moving in a slow spinning state, thereby avoiding color switching by mistake, and thus reliability in use is achieved. One end of the movable color block is provided with an installing groove for installing a balance weight, and the installation is stable.

Further, the mop head is provided with the sliding groove for installing the movable color block. The movable color block is slidably installed inside the sliding groove and slides smoothly. When the mop head spins at high speed, the movable color block slides along the sliding groove under the action of centrifugal force.

Further, the visible window is arranged on the surface of the mop head facing away from the mop cloth, the movable color block includes a movable block and a color block corresponding to the visible window, and the color block is fixedly installed on the movable block. Users can observe the color of the color block through the visible window, and when the color block slides out of the visible range of the visible window, the color of the visible window switches.

Further, the color block is arranged on one side under the visible window. When the mop head is stationary or spins slowly, no color block is under the visible window. At this time, the color of the color block cannot be observed through the visible window. When the mop head spins at high speed, the movable block drives the color block to enter under the visible window. At this time, the color of the color block can be observed through the visible window.

Further, the color block may also be correspondingly arranged under the visible window. When the mop head is stationary or spins slowly, the color block is placed under the visible window. At this time, the color of the color block can be observed through the visible window. When the mop head spins at high speed, the movable block drives the color block to get away from under the visible window. At this time, the color of the color block cannot be observed through the visible window.

Further, the movable color block is provided with a damping mechanism. When the mop head spins slowly, the damping mechanism stops the color block from moving, i.e. prevents the color block from moving in a slow spinning state, thereby avoiding color switching by mistake, and thus reliability in use is achieved. When the mop head spins at high speed, the movable color block overcomes the resistance of the damping mechanism to drive the color block to enter the visible range of the visible window, thereby completing the color switching.

Further, the damping mechanism includes an elastic member, one end of the elastic member is connected to a first installing portion of the movable color block, the other end of the elastic member is connected to a second installing portion of the mop head, and the elastic member is a tension spring. When the mop head spins at high speed, the movable color block overcomes elastic force of the elastic member to drive the color block to enter the visible range of the visible window, thereby completing the color switching.

Further, the damping mechanism includes a balance weight, and one end of the movable color block is provided with an installing groove for installing the balance weight, and the installation is stable.

Further, the movable color block is provided with a protrusion, the protrusion is provided with a bevel, and the mop head is provided with a clamping portion. When the mop head spins slowly to perform cleaning, the mop head is clamped to a rotary water-spraying device of the external mop bucket via the clamping portion and makes the rotary water-spraying device rotate for spraying water. When the mop head spins at high speed to perform spin-drying, the protrusion lifts the mop head up via the bevel and makes the clamping portion detach from the rotary water-spraying device. The structure and function of the rotary water-spraying device of the mop bucket belonging to the prior art have been disclosed in other patent documents, and will not be elaborated here.

Further, the visible window is fixedly provided with a transparent cover, which facilitates users to observe changes in the position of color blocks while playing a dust-proof role.

(III) Beneficial Effects

The spin mop with visible spin-drying/cleaning state of the present invention is simple in structure and low in production cost. The spin mop is provided with the color difference switching mechanism. The visible window can switch different colors according to the different spinning speeds of the mop head, making it easy for users to distinguish the cleaning or spin-drying state of the mop head, and making it convenient for users to spin-dry the mop, and thus the mop is more convenient to use. The mop head is provided with a sliding groove for installing a movable color block, and the movable color block is slidably installed inside the sliding groove and slides smoothly. The movable color block is provided with the damping mechanism. When the mop head spins slowly, the damping mechanism stops the color block from moving, i.e. prevents the color block from moving in a slow spinning state, thereby avoiding color switching by mistake, and thus reliability in use is achieved. One end of the movable color block is provided with an installing groove for installing the balance weight, and the installation is stable. The visible window is fixedly provided with a transparent cover, which facilitates users to observe changes in the position of color blocks while playing a dust-proof role.

Figure 1:
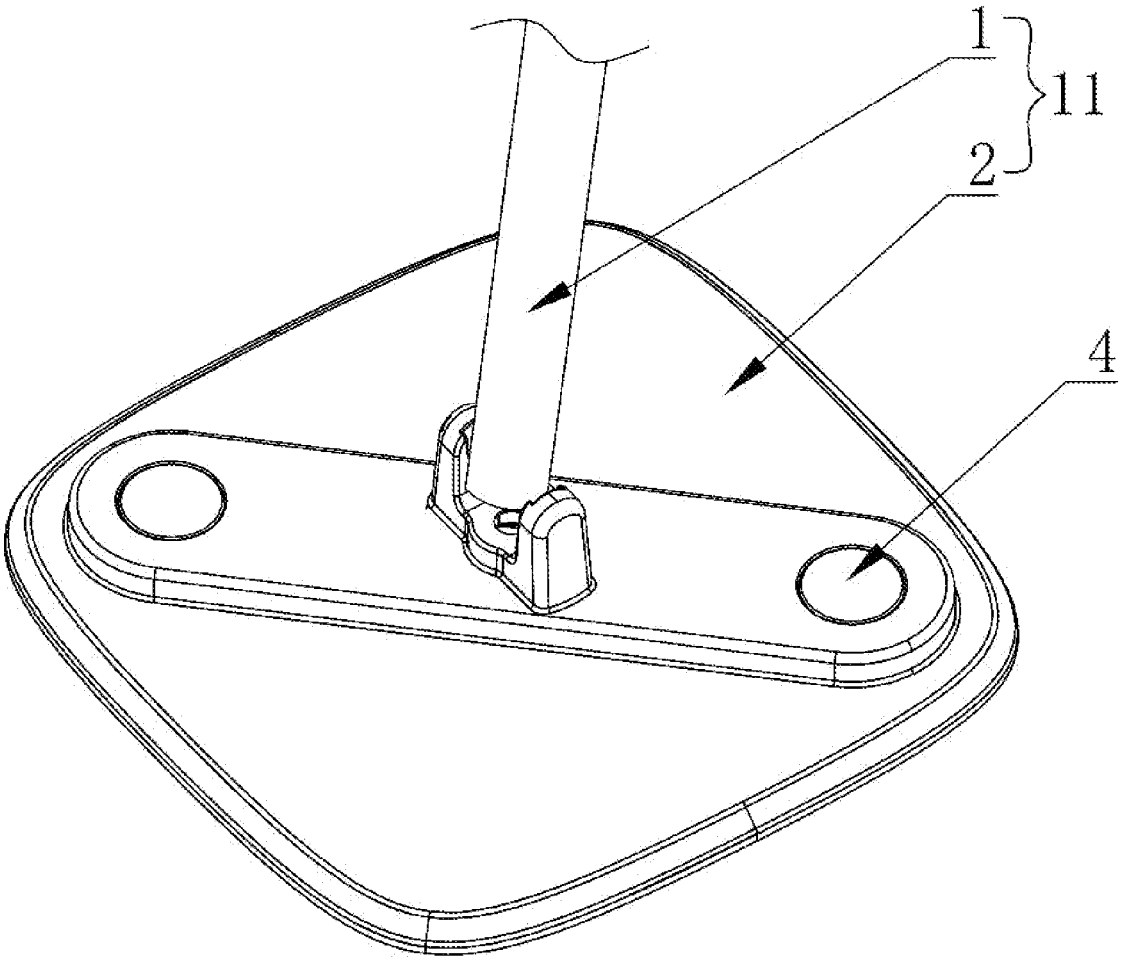
FIG. 1 is a stereogram of a spin mop with visible spin-drying/cleaning state of the present invention.

In the figure, 1 denotes a mop rod; 2 denotes a mop head; 201 denotes a sliding groove; 202 denotes a clamping portion; 203 denotes a second installing portion; 3 denotes a movable color block; 301 denotes an installing groove; 302 denotes a protrusion; 303 denotes a bevel; 304 denotes a first installing portion; 4 denotes a visible window; 5 denotes a color block; 6 denotes an elastic member; 7 denotes a balance weight; 8 denotes a transparent cover; 9 denotes a movable block; 10 denotes a mop bucket; 11 denotes a spin mop; and 12 denotes a support seat.

DETAILED DESCRIPTION

Embodiment I

Referring to FIG. 1 to FIG. 8, Embodiment I provides a spin mop with visible spin-drying/cleaning state, including a mop bucket 10 and a spin mop body 11. The mop bucket 10 is provided with a support seat 12 for supporting the spin mop body 11 to spin. The spin mop body 11 includes a mop rod 1 and a mop head 2 for installing a mop cloth. The mop head 2 is provided with a color difference switching mechanism. The color difference switching mechanism includes a movable color block 3 movably installed on the mop head 2 and a visible window 4 provided corresponding to the movable color block 3. The movable color block 3 is slidably/swingingly connected to the mop head 2. When the mop head spins slowly to perform cleaning, the movable color block is stationary or moves slightly, and the color in the visible window is unchanged. When the mop head 2 spins at high speed to perform spin-drying, the movable color block 3 slides/swings towards the visible window 4 or the movable color block 3 slides/swings away from the visible window 4, such that the movable color block 3 is placed under or gets away from under the visible window 4, the color inside the visible window 4 changes, and the users can distinguish the spinning speed of the mop head by the color of the visible window 4 during use, thereby distinguishing whether the mop head is in a cleaning or spin-drying state according to the color of the visible window 4, which is convenient to use. In the spin mop with visible spin-drying/cleaning state of the present invention, one end of the movable color block is provided with an installing groove for installing a balance weight, and the installation is stable. The visible window is fixedly provided with a transparent cover, which facilitates users to observe changes in the position of color blocks while playing a dust-proof role. The structure is simple and the production cost is low. The spin mop is provided with the color difference switching mechanism. The visible window can switch different colors according to the different spinning speeds of the mop head, making it easy for users to distinguish the cleaning or spin-drying state of the mop head, and making it convenient for users to spin-dry the mop, and thus the mop is more convenient to use. The mop head is provided with a sliding groove for installing a movable color block, and the movable color block is slidably installed inside the sliding groove and slides smoothly. The movable color block is provided with a damping mechanism. When the mop head spins slowly, the damping mechanism stops the color block from moving, i.e. prevents the color block from moving in a slow spinning state, thereby avoiding color switching by mistake, and thus reliability in use is achieved.

Referring to FIG. 1 to FIG. 4, the mop head 2 is provided with a sliding groove 201 for installing a movable color block 3, and the movable color block 3 is slidably installed inside the sliding groove 201 and slides smoothly. When the mop head 2 spins at high speed, the movable color block 3 slides along the sliding groove 201 under the action of centrifugal force. In this embodiment, there are two movable color blocks 3. The visible window 4 is arranged on the surface of the mop head 2 facing away from the mop cloth. The movable color block 3 includes a movable block 9 and a color block 5 corresponding to the visible window 4. The color block 5 is fixedly installed on the movable block 9. Users can observe the color of the color block through the visible window 4. When the color block slides out of the visible range of the visible window 4, the color of the visible window 4 switches. The color block 5 is arranged on one side under the visible window 4. When the mop head 2 is stationary or spins slowly, no color block 5 is under the visible window 4. At this time, the color of the color block 5 cannot be observed through the visible window 4. When the mop head 2 spins at high speed, the movable color block 3 drives the color block 5 to enter under the visible window 4. At this time, the color of the color block 5 can be observed through the visible window 4.

Referring to FIG. 1, FIG. 2, FIG. 3 and FIG. 5, the movable color block 3 is provided with a damping mechanism. When the mop head 2 spins slowly, the damping mechanism stops the color block 5 from moving, i.e. prevents the color block from moving in a slow spinning state, thereby avoiding color switching by mistake, and thus reliability in use is achieved. When the mop head 2 spins at high speed, the movable color block 3 overcomes the resistance of the damping mechanism to drive the color block 5 to enter the visible range of the visible window 4, thereby completing the color switching. The damping mechanism includes an elastic member 6, one end of the elastic member 6 is connected to a first installing portion 304 of the movable color block 3, the other end of the elastic member 6 is connected to a second installing portion 203 of the mop head 2, and the elastic member 6 is a tension spring. When the mop head 2 spins at high speed, the movable block 9 overcomes elastic force of the elastic member 6 to drive the color block 5 to enter the visible range of the visible window 4, thereby completing the color switching.

Figure 2:
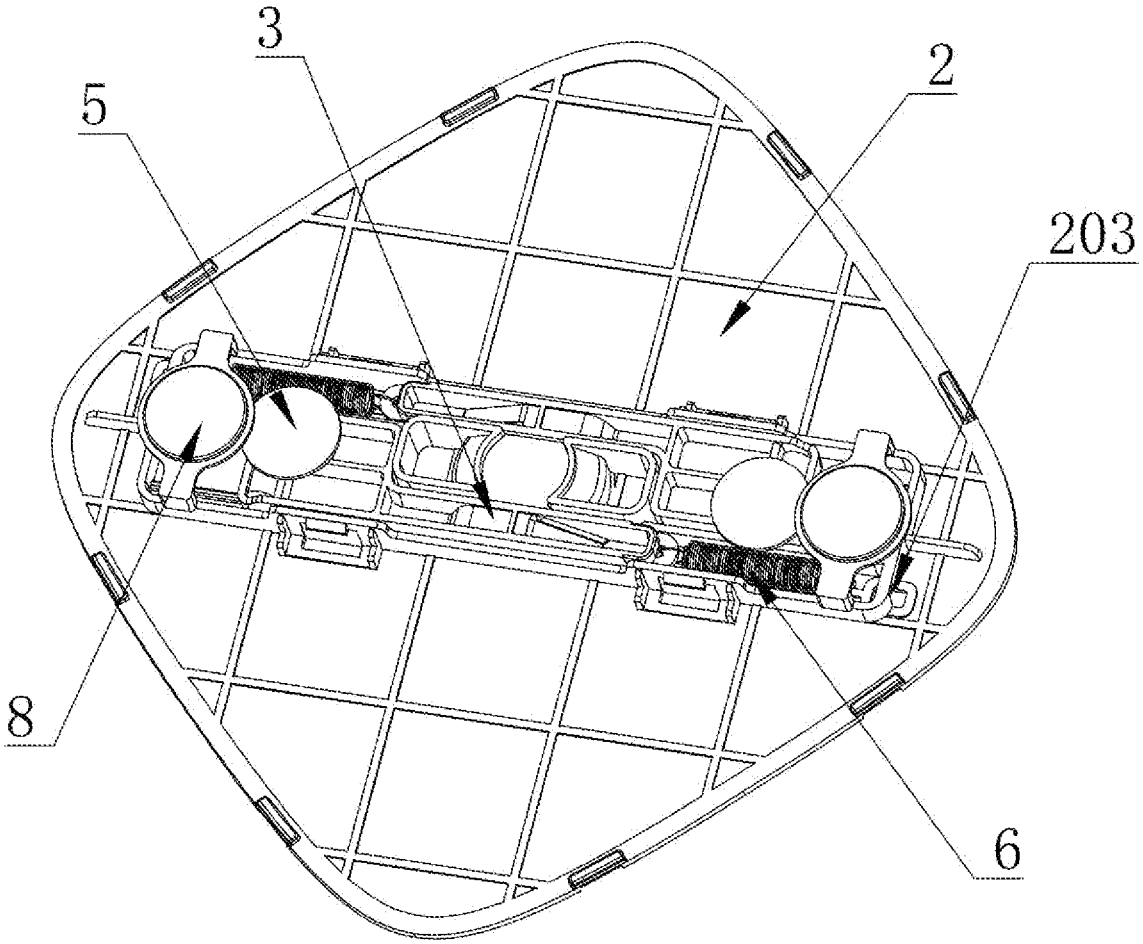
FIG. 2 is a schematic structural diagram of the spin mop with visible spin-drying/cleaning state of the present invention in a stationary or slow spinning state.
Figure 3:
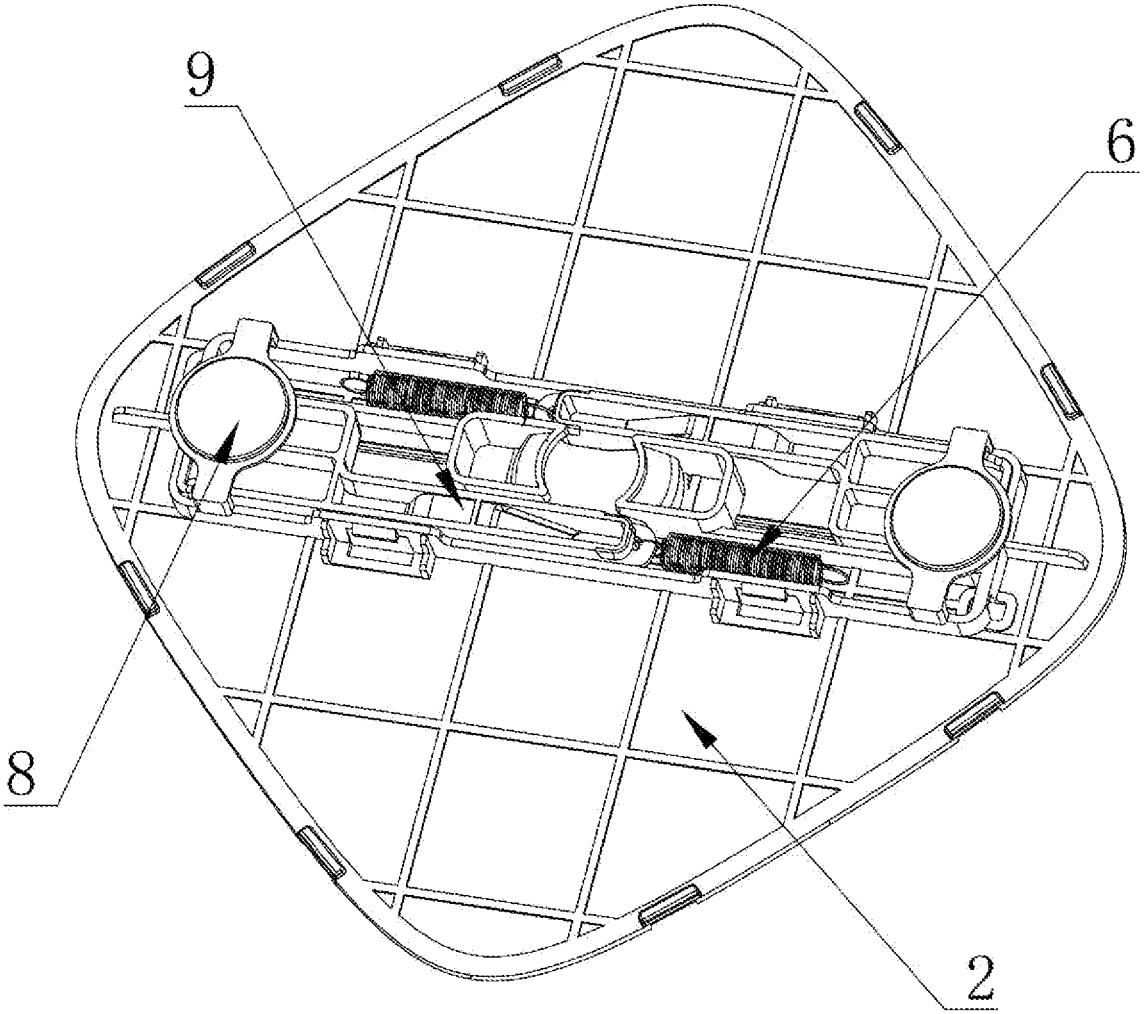
FIG. 3 is a schematic structural diagram of the spin mop with visible spin-drying/cleaning state of the present invention in a fast spinning state.
Figure 4:
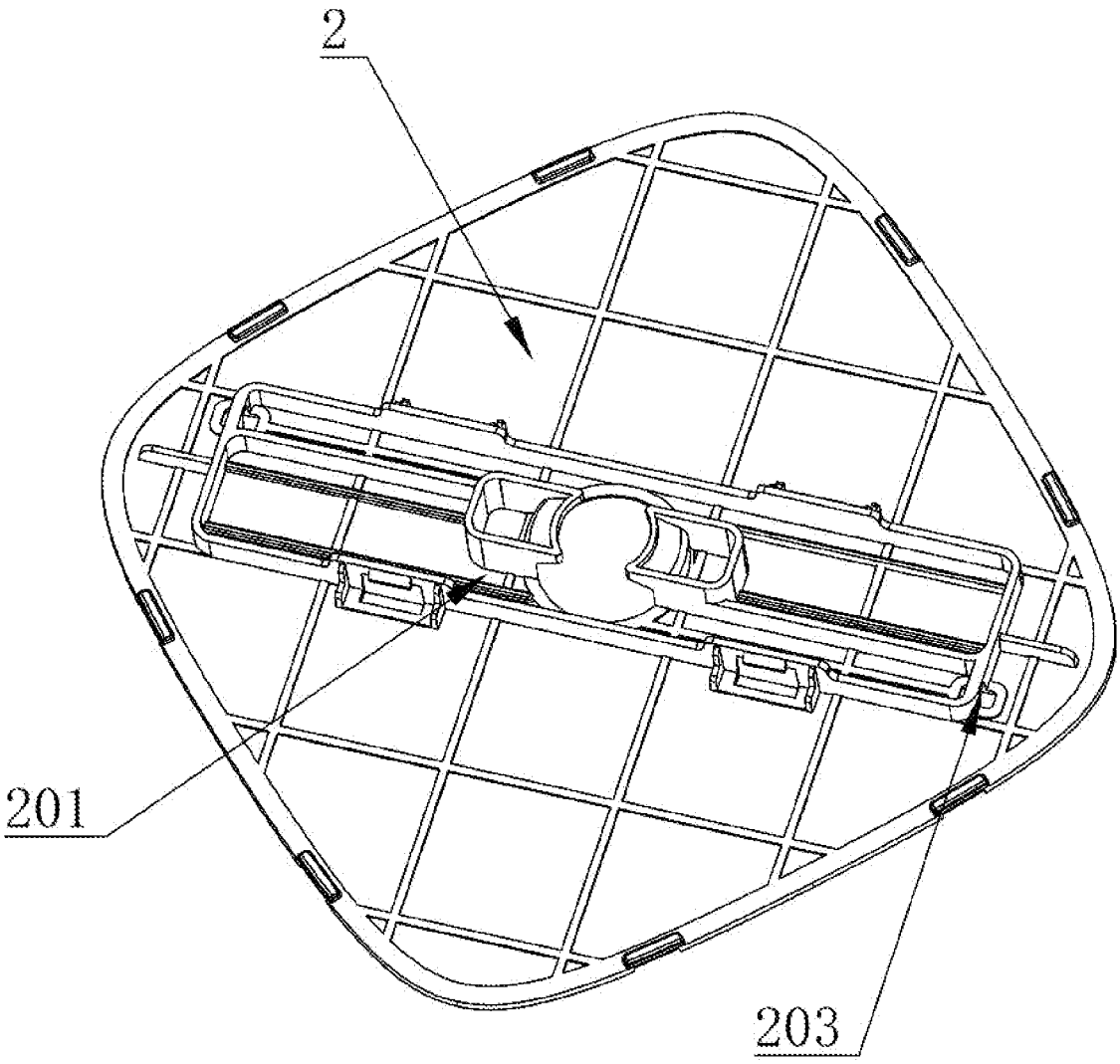
FIG. 4 is a schematic structural diagram of a sliding groove of the spin mop with visible spin-drying/cleaning state of the present invention.
Figure 5:
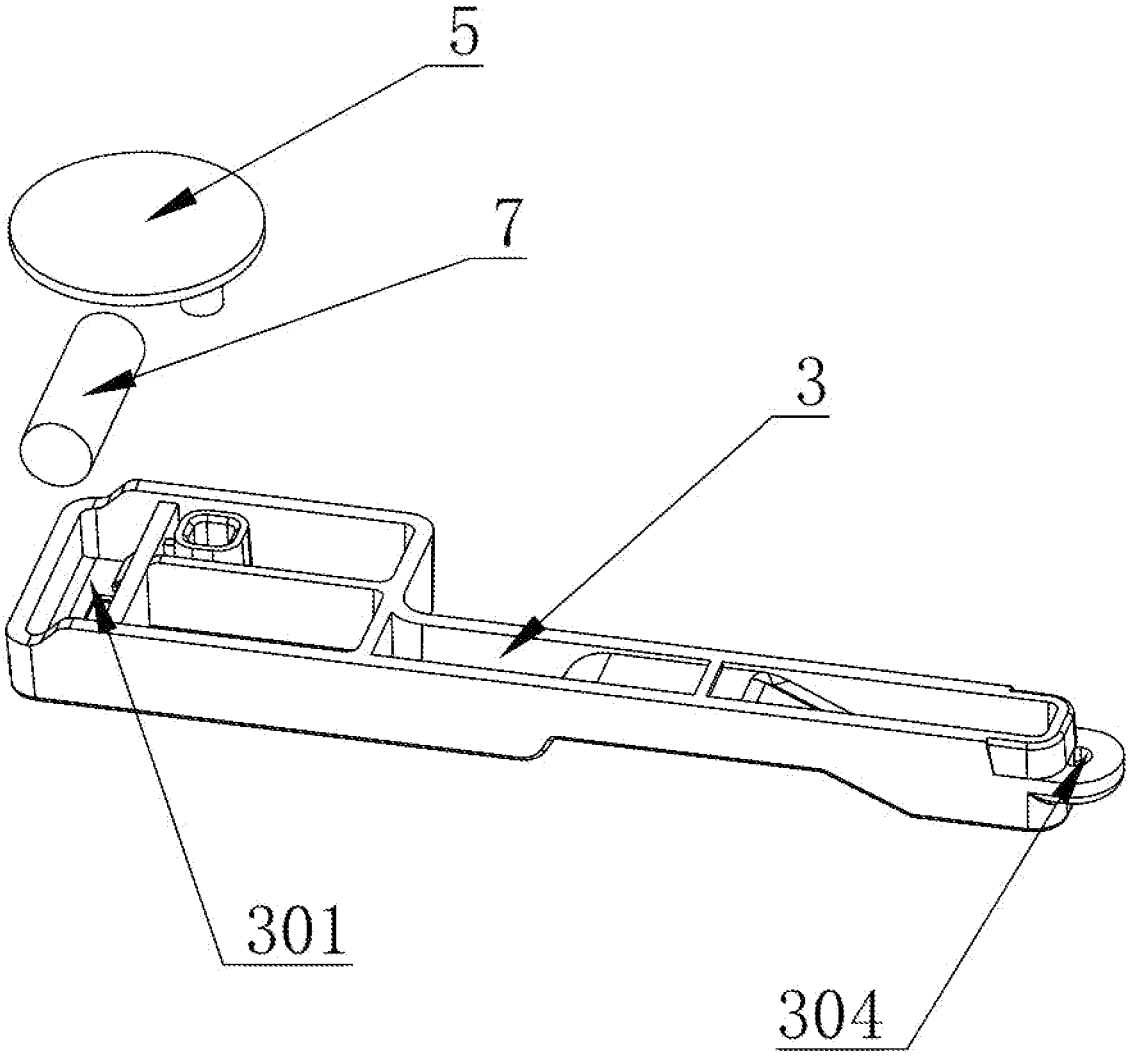
FIG. 5 is a schematic structural diagram of a movable color block of the spin mop with visible spin-drying/cleaning state of the present invention.
Figure 6:
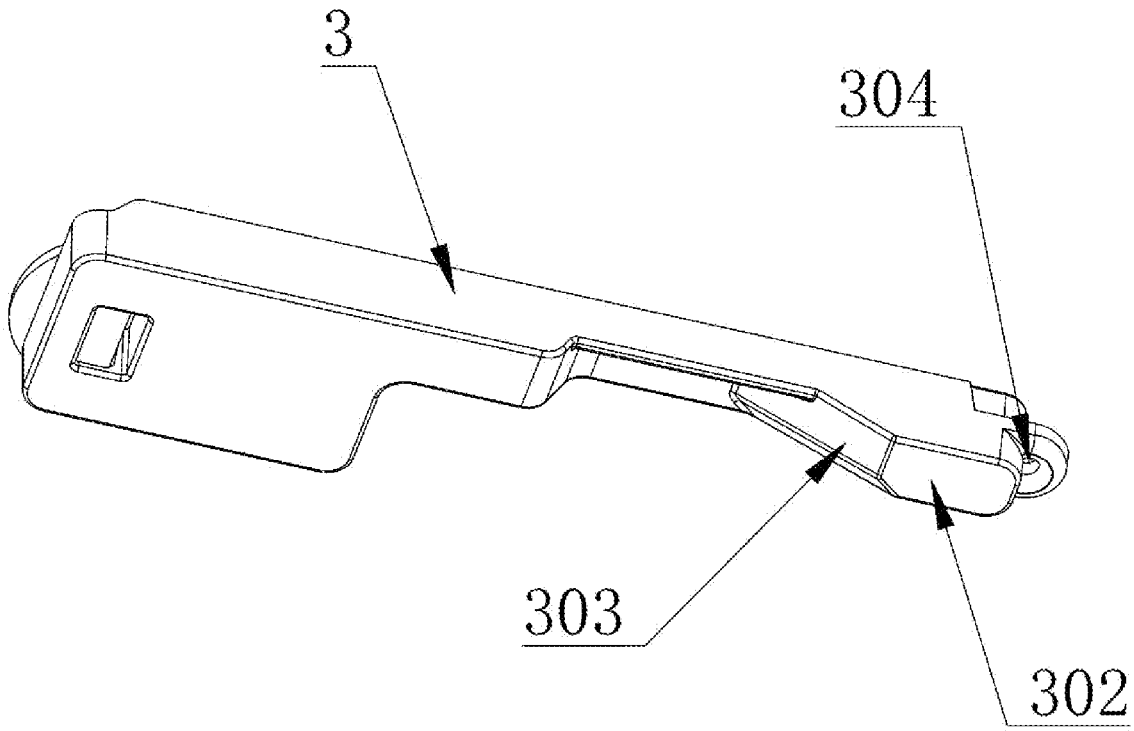
FIG. 6 is a stereogram of the bottom of the movable color block of the spin mop with visible spin-drying/cleaning state of the present invention.
Figure 7:
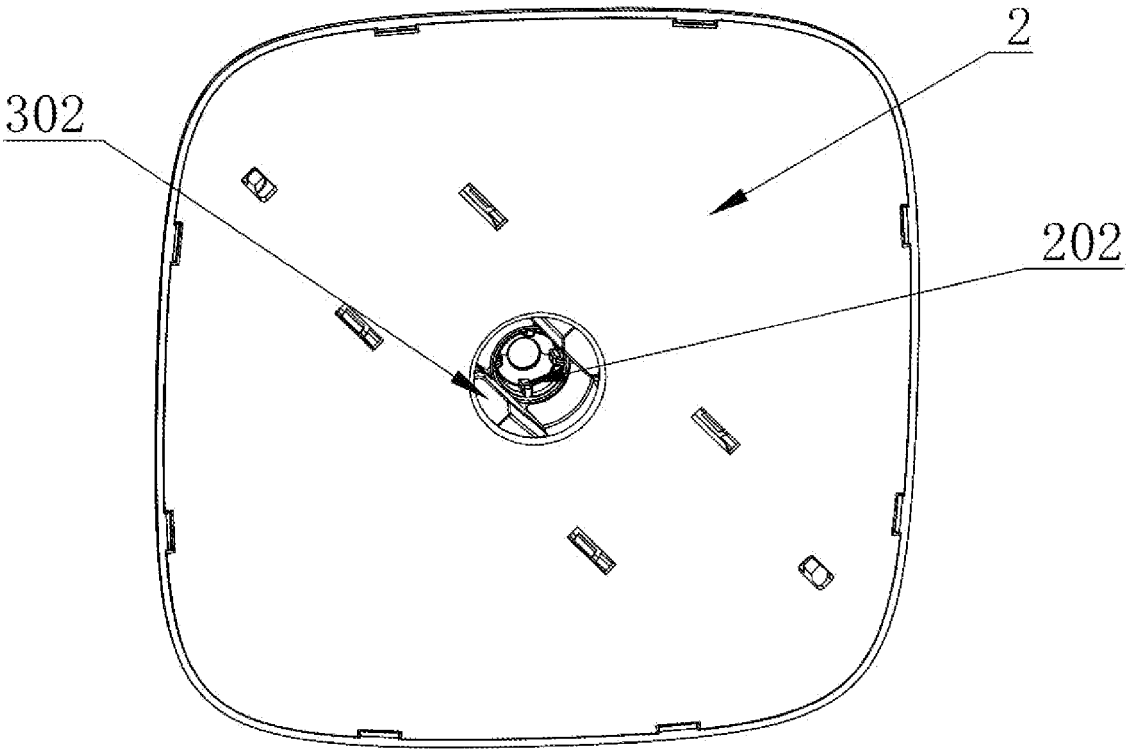
FIG. 7 is a stereogram of the bottom of a mop head of the spin mop with visible spin-drying/cleaning state of the present invention.
Figure 8:
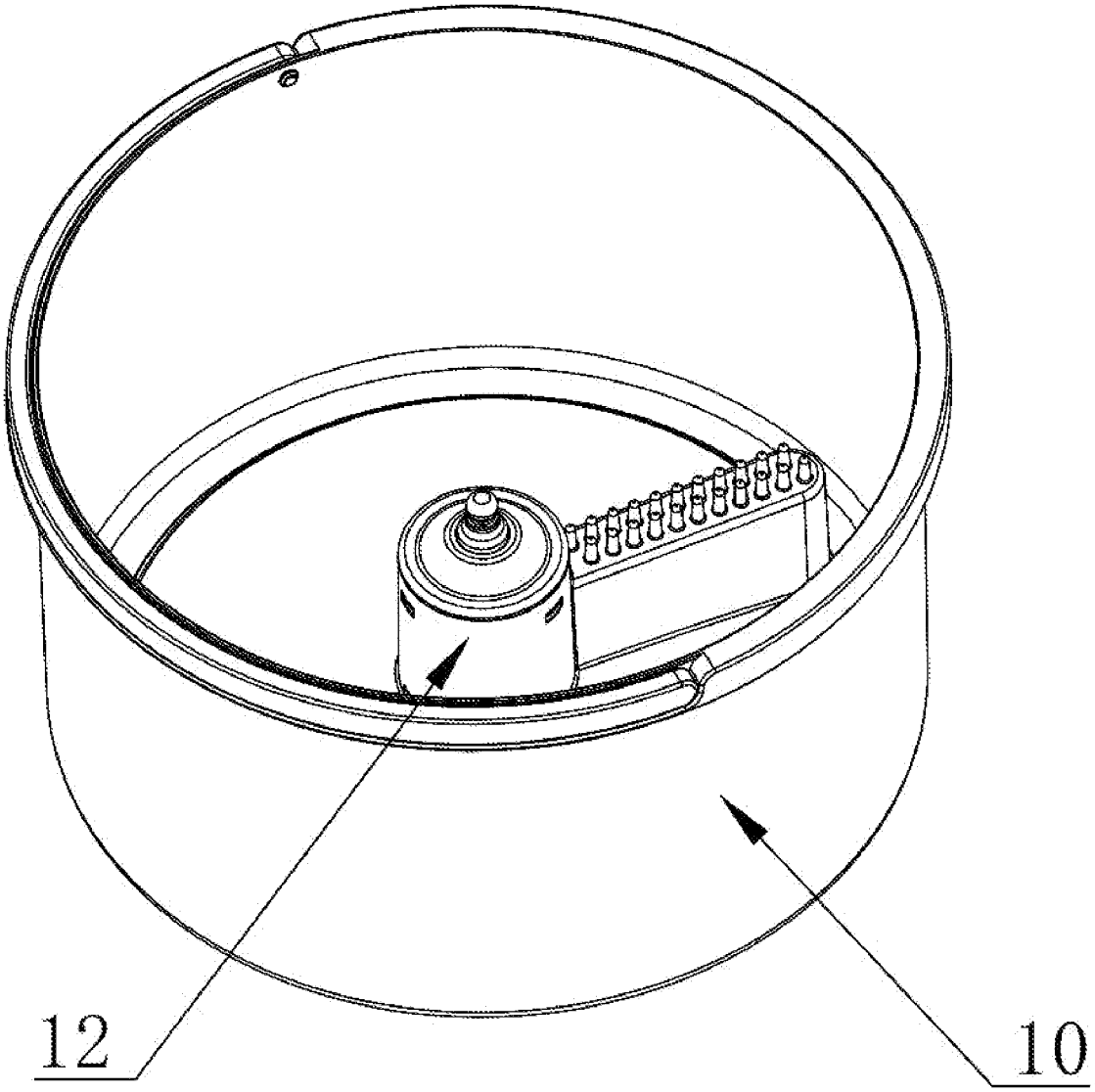
FIG. 8 is a schematic structural diagram of a mop bucket of the spin mop with visible spin-drying/cleaning state of the present invention.

Referring to FIG. 2, FIG. 3 and FIG. 5, the damping mechanism includes a balance weight 7, and one end of the movable color block 3 is provided with an installing groove 301 for installing the balance weight 7, and the installation is stable.

Referring to FIG. 1, FIG. 2, FIG. 6 and FIG. 7, the movable color block 3 is provided with a protrusion 302, the protrusion 302 is provided with a bevel 303, and the mop head 2 is provided with a clamping portion 202. When the mop head 2 spins slowly to perform cleaning, the mop head 2 is clamped to a rotary water-spraying device of the external mop bucket via the clamping portion 202 and makes the rotary water-spraying device rotate for spraying water. When the mop head 2 spins at high speed to perform spin-drying, the protrusion 302 lifts the mop head 2 up via the bevel 303 and makes the clamping portion 202 detach from the rotary water-spraying device. The structure and function of the rotary water-spraying device of the mop bucket belonging to the prior art have been disclosed in other patent documents, and will not be elaborated here.

Referring to FIG. 1 and FIG. 2, the visible window 4 is fixedly provided with a transparent cover 8, which facilitates users to observe changes in the position of color blocks while playing a dust-proof role.

Embodiment II

The difference between Embodiment II and Embodiment I is that: the color block 5 is correspondingly arranged under the visible window 4. When the mop head 2 is stationary or spins slowly, the color block 5 is placed under the visible window 4. At this time, the color of the color block 5 can be observed through the visible window 4. When the mop head 2 spins at high speed, the movable block 9 drives the color block 5 away from under the visible window 4. At this time, the color of the color block 5 cannot be observed through the visible window 4, thereby completing the color switching and making it convenient to use.

The present invention provides the spin mop with visible spin-drying/cleaning state. The movable color block is provided with a damping mechanism. When the mop head spins slowly, the damping mechanism stops the color block from moving, i.e. prevents the color block from moving in a slow spinning state, thereby avoiding color switching by mistake, and thus reliability in use is achieved. One end of the movable color block is provided with an installing groove for installing a balance weight, and the installation is stable. The visible window is fixedly provided with a transparent cover, which facilitates users to observe changes in the position of color blocks while playing a dust-proof role. The structure is simple and the production cost is low. The spin mop is provided with the color difference switching mechanism. The visible window can switch different colors according to the different spinning speeds of the mop head, making it easy for users to distinguish the cleaning or spin-drying state of the mop head, and making it convenient for users to spin-dry the mop, and thus the mop is more convenient to use. The mop head is provided with a sliding groove for installing a movable color block, and the movable color block is slidably installed inside the sliding groove and slides smoothly.

The above are only the preferred implementations of the present invention. It should be pointed out that for those of ordinary skill in the art, several improvements and embellishments can be made without departing from the technical principles of the present invention. These improvements and embellishments should also be considered as the protection scope of the present invention.

What is claimed is:

1. A spin mop with visible spin-drying/cleaning state, comprising: a mop bucket (10) and a spin mop body (11), the mop bucket (10) being provided with a support seat (12) for supporting the spin mop body (11) to spin, the spin mop body (11) comprising a mop rod (1) and a mop head (2) for installing a mop cloth, wherein the mop head (2) is provided with a color difference switching mechanism, the color difference switching mechanism comprises a movable color block (3) movably installed on the mop head (2) and a visible window (4) provided corresponding to the movable color block (3), and the movable color block (3) is slidably/swingingly connected to the mop head (2); and when the mop head (2) spins at high speed to perform spin-drying, the movable color block (3) slides/swings towards the visible window (4) or the movable color block (3) slides/swings away from the visible window (4), such that the movable color block (3) is placed under or gets away from under the visible window (4).

2. The spin mop with visible spin-drying/cleaning state according to claim 1, wherein the mop head (2) is provided with a sliding groove (201) for installing the movable color block (3), and the movable color block (3) is slidably installed inside the sliding groove (201).

3. The spin mop with visible spin-drying/cleaning state according to claim 1, wherein the visible window (4) is arranged on the surface of the mop head (2) facing away from the mop cloth, the movable color block (3) comprises a movable block (9) and a color block (5) corresponding to the visible window (4), and the color block (5) is fixedly installed on the movable block (9).

4. The spin mop with visible spin-drying/cleaning state according to claim 3, wherein the color block (5) is arranged on one side under the visible window (4); when the mop head (2) is stationary or spins slowly, no color block (5) is under the visible window (4); and when the mop head (2) spins at high speed, the movable block (9) drives the color block (5) to enter under the visible window (4).

5. The spin mop with visible spin-drying/cleaning state according to claim 3, wherein the color block (5) is correspondingly arranged under the visible window (4); when the mop head (2) is stationary or spins slowly, the color block (5) is placed under the visible window (4); and when the mop head (2) spins at high speed, the movable block (9) drives the color block (5) to get away from under the visible window (4).

6. The spin mop with visible spin-drying/cleaning state according to claim 3, wherein the movable block (9) is provided with a damping mechanism; and when the mop head (2) spins slowly, the damping mechanism prevents the color block (5) from moving.

7. The spin mop with visible spin-drying/cleaning state according to claim 6, wherein the damping mechanism comprises an elastic member (6), one end of the elastic member (6) is connected to a first installing portion (304) of the movable color block (3), the other end of the elastic member (6) is connected to a second installing portion (203) of the mop head (2), and the elastic member (6) is a tension spring.

8. The spin mop with visible spin-drying/cleaning state according to claim 6, wherein the damping mechanism comprises a balance weight (7), and one end of the movable color block (3) is provided with an installing groove (301) for installing the balance weight (7).

9. The spin mop with visible spin-drying/cleaning state according to claim 1, wherein the movable color block (3) is provided with a protrusion (302), the protrusion (302) is provided with a bevel (303), the mop head (2) is provided with a clamping portion (202); when the mop head (2) spins slowly to perform cleaning, the mop head (2) is clamped to a rotary water-spraying device of the external mop bucket via the clamping portion (202) and makes the rotary water-spraying device rotate for spraying water; and when the mop head (2) spins at high speed to perform spin-drying, the protrusion (302) lifts the mop head (2) up via the bevel (303) and makes the clamping portion (202) detach from the rotary water-spraying device.

10. The spin mop with visible spin-drying/cleaning state according to claim 1, wherein the visible window (4) is fixedly provided with a transparent cover (8).

* * * * *